US007228770B2

(12) United States Patent
Rozo et al.

(10) Patent No.: US 7,228,770 B2
(45) Date of Patent: Jun. 12, 2007

(54) PLIERS

(76) Inventors: Juan M. Rozo, 1018 Sinsburry Ct., Crofton, MD (US) 21114; John T. Petronio, 4500 Summer Ridge Ct., Mount Airy, MD (US) 21771

( * ) Notice: Subject to any disclaimer, the term of this patent is extended or adjusted under 35 U.S.C. 154(b) by 135 days.

(21) Appl. No.: 10/631,788

(22) Filed: Aug. 1, 2003

(65) Prior Publication Data

US 2005/0022633 A1 Feb. 3, 2005

(51) Int. Cl.
*B25B 7/02* (2006.01)

(52) U.S. Cl. ..... 81/418; 81/424; 81/424.5

(58) Field of Classification Search ..... 81/418, 81/424, 424.5, 426.5
See application file for complete search history.

(56) References Cited

U.S. PATENT DOCUMENTS 2,439,501 A * 4/1948 Yelkin ..... 29/235
3,171,132 A * 3/1965 Dritz ..... 227/60
4,054,969 A * 10/1977 Vogt ..... 452/132
4,070,745 A * 1/1978 Schimmelman ..... 29/268
4,170,125 A * 10/1979 Minka ..... 72/409.13
4,817,287 A * 4/1989 Arnold et al. ..... 30/178
D342,002 S * 12/1993 Sage ..... D8/52
5,351,402 A * 10/1994 Mansfield ..... 30/120.3
5,884,540 A * 3/1999 Mo ..... 81/423
6,293,790 B1 * 9/2001 Hilliard ..... 433/4
D453,812 S * 2/2002 Grayson ..... D22/150
6,574,847 B1 * 6/2003 Scroggins ..... 29/249

* cited by examiner

*Primary Examiner*—Lee D. Wilson
*Assistant Examiner*—Alvin J. Grant
(74) *Attorney, Agent, or Firm*—Lowe Hauptman & Berner, LLP

(57) ABSTRACT

Pliers for installing a bushing within a drive selector linkage assembly of an automobile. The pliers include a first arm having a first handle portion and a holder portion. The holder portion is configured to independently hold a bushing to be installed within a drive selector linkage assembly of an automobile. The pliers also include a second arm pivotally mounted to the aforementioned first arm and have a second handle portion and a gripping portion. The gripping portion is configured to apply a force to the bushing suitable to install the bushing within the drive selector linkage assembly of the automobile when the first and second handles of the first and second arms, respectfully, are pivotally operated.

21 Claims, 9 Drawing Sheets

PLIERS

BACKGROUND OF THE INVENTION

1. Technical Field

The present invention relates to tools used to perform installation of parts within an automobile. More particularly, the present invention relates to pliers (also referred to as "pairs of pliers") that now may be used to install bushings within drive selector assemblies of automobiles.

2. Description of the Related Art

Hand tools are highly desirable devices that aid in the performance of innumerable tasks. The types and designs of hand tools are as diverse as the range of tasks that they are used to perform. One common hand tool used is pliers, which is also referred to as a pair of pliers. Pliers are a gripping hand tool formed from a pair of pivotally mounted arms that commonly have serrated jaws formed at one end. These serrated jaws are typically used to grip and apply force to mechanical components such as nuts, bolt heads, shafts, and the like. Depending upon the task at hand, pliers are used for practically any gripping task imaginable.

One area where the use of pliers is common is in the field of automobile maintenance and repair. Performing maintenance on an automobile commonly requires the use of a pair of pliers to grip, position, and apply force to various components. Depending upon the make and model of an automobile, the systems and components that need maintenance can require varying degrees of effort. It is easy to gain access to many automobile systems and components. However, some systems and components require considerable time and effort to reach and repair.

In order to perform maintenance on certain systems and components within an automobile, especially the engine and drive system, it is commonly needed to remove various parts of the engine to provide access. This process can prove time consuming and labor intensive. And, unfortunately, some hard to reach parts may be repaired or replaced very quickly only after a very long delay resulting from the need to temporarily remove other structures such as exhaust systems, etc that may otherwise be in the way. And, when done by a commercial mechanic, this process can prove unprofitable and expensive. One example of such a difficult-to-reach component is a bushing positioned within a drive selector linkage assembly of an automobile. During the lifetime of an automobile, the bushing may wear out and require replacement. Installation of such a replacement bushing can require the removal of several automobile components, requiring substantial labor and time.

There are many individuals who enjoy putting large amounts of time and labor into their automobiles. However, having quick and easy access to as much of a car as possible enables professional automobile mechanics to provide economical and profitable maintenance service to their customers. Improved hand tool designs that are able to reach those difficult to access engine components are one method of reducing labor times and costs. It is therefore highly desirable to provide improved hand tool designs to facilitate greater and easier access to more components within automobiles. More specifically, it is highly desirable to develop a novel hand tool that can install bushing positioned within the drive selector linkage assembly of an automobile without removal of any automobile components to provide access.

SUMMARY OF THE INVENTION

The present invention is a novel hand tool used to perform installation of mechanical components within an automobile or other similar structure. More particularly, the present invention is pliers (also referred to as "pairs of pliers") that are used to grip and install thick annular components such as bushings. And, the present invention enables the installation of bushings within drive selector assemblies of automobiles.

Pliers provided by the present invention include a first arm having a first handle portion and a holder portion. The holder portion is configured to independently hold a bushing to be installed within a drive selector linkage assembly of an automobile. The pliers also include a second arm pivotally mounted to the aforementioned first arm and have a second handle portion and a gripping portion. The gripping portion is configured to apply a force to the bushing suitable to install the bushing within the drive selector linkage assembly of the automobile when the first and second handles of the first and second arms, respectfully, are pivotally operated.

According to another embodiment, pliers are provided that include a first arm having a first handle portion and a holder portion. The holder portion is configured to independently hold a part to be installed within an automobile. The pliers also include a second arm pivotally mounted to the first arm and have a second handle portion and a gripping portion. The gripping portion is configured to apply a force to the part suitable to install the part within the automobile when the first and second handles of the first and second arms are pivotally operated.

These and other aspects of the present invention are discussed in detail below with exemplary reference to the attached sheets of drawings which are briefly described in the next section of this patent document.

BRIEF DESCRIPTION OF THE DRAWING FIGURES

The present invention is discussed in detail below with regard to the attached drawing figures, of which:

DETAILED DESCRIPTION OF THE PREFERRED EMBODIMENTS

Figure 1:
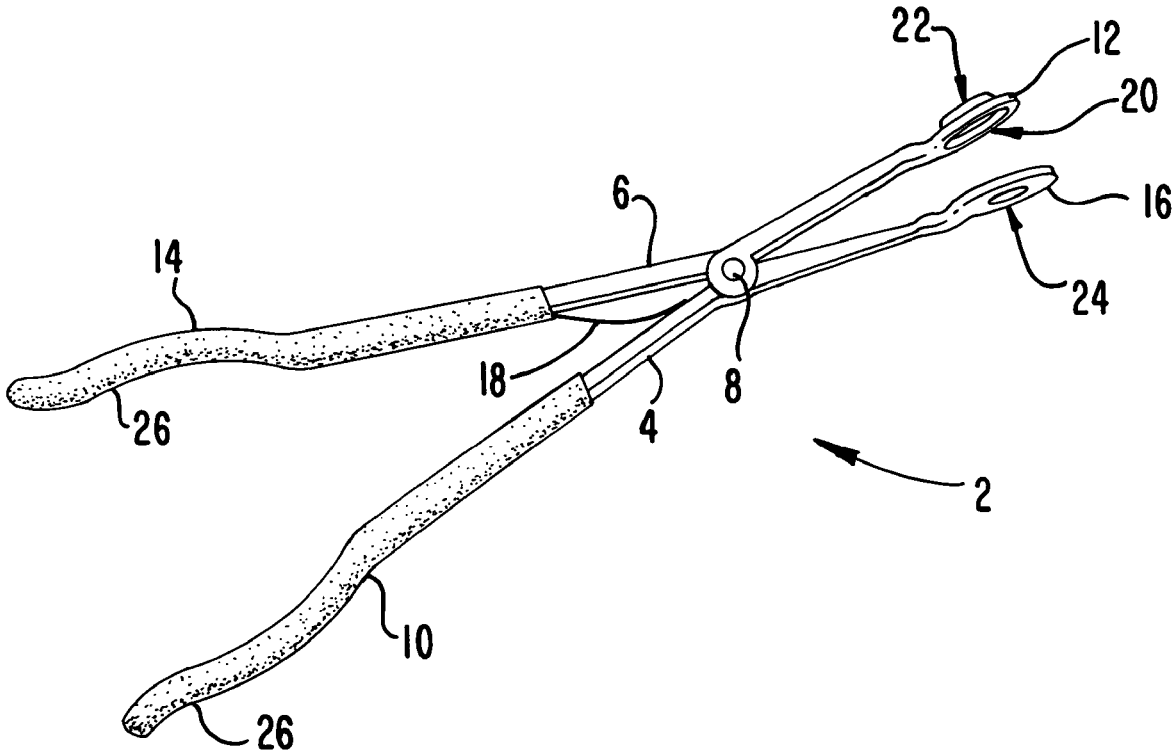
FIG. 1 illustrates a perspective view of a preferred embodiment of the present invention in an open position.

The present invention is now described with reference to the preferred embodiments shown in the attached drawing figures which were briefly described above. Like parts are referred to with like reference numerals.

Referring now to the Figures, FIG. 1 illustrates a perspective view of a preferred embodiment of the present invention in an open position. A pair of pliers 2 disposed in the open position is illustrated in FIG. 1. Pliers 2 are primarily used to hold and install automotive parts such as bushings within an automobile such as within a drive selector linkage assembly of an automobile (e.g., a Mercedes Benz automobile, etc.). In addition, pliers 2 are also able to support and install bushings, thick washers, ball bearing assemblies, and a variety of other thick annular components and other parts on various shafts, rods, and the like in automobiles and in other structures.

A first arm 4 is pivotally mounted to a second arm 6. A pivot joint 8 pivotally couples first arm 4 to second arm 6. First arm 4 includes a first handle portion 10 on one end and a holder portion 12 at an opposite end. Second arm 6 includes a second handle portion 14 on one end and a gripping portion 16 at an opposite end. A strip 18 is coupled to second arm 6. Arms 4 and 6 are have extended handles 10 and 14 to enable pliers 2 to reach a drive selector linkage assembly of an automobile. For purposes of example only, to reach a bushing installation location on a drive selector assembly within a Mercedes-Benz E-class automobile, extended handles 10 and 14 should be at least 12–15 inches in length. Of course, particular applications for pliers 2 may dictate that extended handles 10 and 14 be of particular length suitable to install parts within a structure such as an automobile, and the present invention certainly contemplates changes in handle lengths to suit particular applications.

Together, holder portion 12 and gripping portion 16 function to support a thick annular component such as a bushing. Holder portion 12 is formed having a recess 20 to enable pliers 2 to grip, to hold, and to support thick annular components like bushings when pliers 2 are in a closed position. A thick annular component such as a bushing rests within recess 20 of holder portion 12. Holder portion 12 is formed in the shape of an annular cup but may be formed or structured to correspond to holding needs of a parts to be installed within a structure such as an automobile.

As shown, there is a first hole 22 formed in holder portion 12 and a second hole 24 formed in gripping portion 16. When in a closed position, hole 22 and hole 24 are aligned such that a shaft or rod could pass through holder portion 12 and gripping portion 16. In this way a bushing or other similar part may be installed in a very tight space (e.g., such as above an exhaust system, etc.) and within a linkage assembly and on a rod or other similar structure without having to remove other automotive structures to gain access to tight spaces.

Strip 18 provides a force against first and second arms 4 and 6 when pliers 2 are in a closed position. When pliers 2 are in a closed position, strip 18 is placed in a state of compression by first and second arms 4 and 6. When a user releases their hand from holding arms 4 and 6 in a closed position, strip 18 pushes first and second arms 4 and 6 back into an open position.

First and second handle portions 10 and 14 are gripped by a user to hold and operate pliers 2. First and second handle portions may be coated with a high friction coating 26 to provide a desirable gripping surface for users in a preferred embodiment. Coating 26 may be formed from a high-friction polymer or rubber. Alternatively, first and second handle portions 10 and 14 can be instead formed to provide a textured gripping surface without the use of a coating 26, such as by forming a series of grooves, a grid of bumps, or some other textured pattern in first and second handles 10 and 14 that improves the gripping surface.

When pliers 2 are in the open positioned depicted in FIG. 1, the user can place a thick annular component between holder portion 12 and gripping portion 16.

Figure 2:
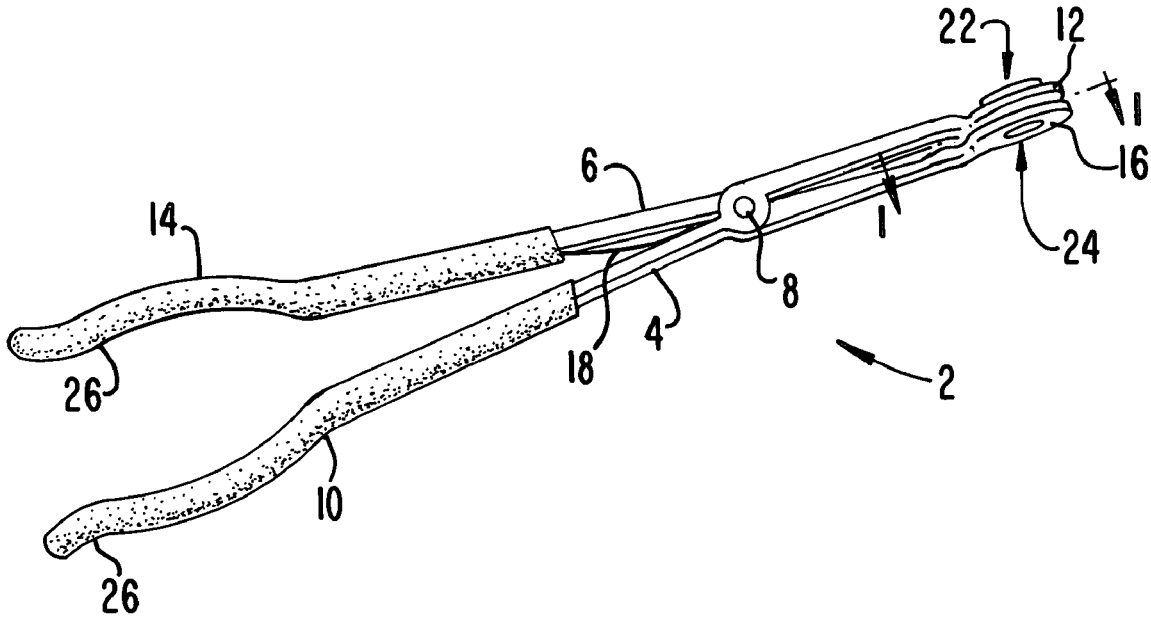
FIG. 2 illustrates a perspective of a preferred embodiment of the present invention in a closed position.

FIG. 2 illustrates a perspective of a preferred embodiment of the present invention in a closed position. In this Figure, first arm 4 and second arm 6 are pivoted about joint 8 into a closed position. When pliers 2 are in this closed position, holder portion 12 is brought into proximity with gripping portion 16. Holder portion 12 and gripping portion 16 form the two surfaces that hold the thick annular component in position like the bushing. When holder portion 12 and gripping portion 16 are in a closed position, holder portion 12 and gripping portion 16 define a cavity formed by recess 20 in which the bushing is contained. Providing recess 20 enables first and second arms 4 and 6 of pliers 2 to come into a closed position while holding the thick annular component.

When in this closed position, strip 18 is deformed such that it creates a force that pushes outward against first and second arms 4 and 6. This outward force is insufficient to prevent easy closure of pliers 2 by the user, but is sufficient to pivot first and second arms 4 and 6 into an open position when first and second handle portions 10 and 14 are released from a closed position.

First and second arms 4 and 6 are given a long length to enable pliers to reach a bushing positioned within a drive selector linkage assembly of an automobile. As a result, pliers 2 can grip and apply force to these bushings within the drive selector linkage with holder portion 12 and gripping portion 16. Holder portion 12 is configured with recess 20 to independently hold the bushing to be installed within the drive selector linkage assembly. Gripping portion 16 is configured to apply a force to the bushing suitable to install the bushing within the drive selector linkage assembly of the automobile when first and second handles 10 and 14 of first and second arms 4 and 6 are pivotally operated.

Figure 3:
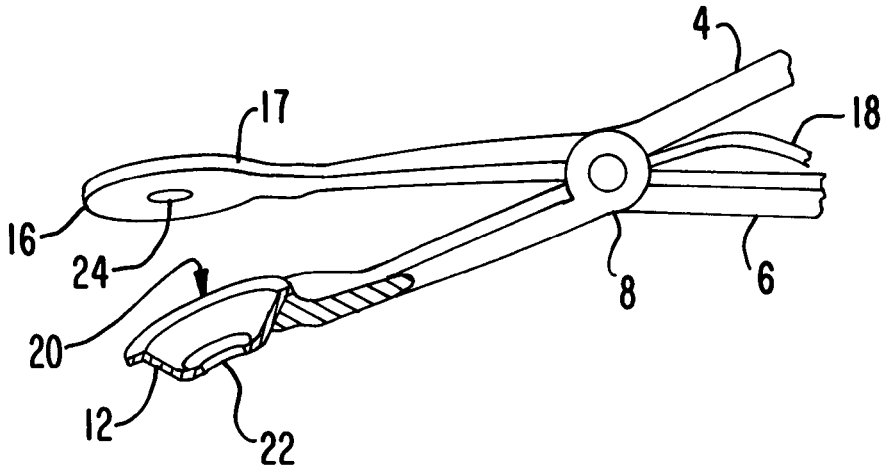
FIG. 3 illustrates a side view of a preferred embodiment of the present invention.

FIG. 3 illustrates a side view of a preferred embodiment of the present invention. First and second arms 4 and 6, together with gripping portion 16 and holding portion 12 form a "jaw" portion of pliers 2 that holds and grips a thick annular component such as a bushing. First and second arms 4 and 6 pivot between open and closed positions about pivot joint 8. In this Figure, a gripping surface 17 of gripping portion 16 is depicted. Gripping surface 17 grips and holds bushings or other thick annular components in position against holder portion 12 when pliers 2 are in a closed position.

Grooves, ridges, or a grid of bumps may be formed into gripping surface 17 in order to increase the ability of gripping surface 17 to grip and hold bushings or other thick annular components in a fixed position against holder portion 12. Additionally, a magnetic material may be formed over gripping surface 17 in order to magnetize gripping surface 17, thereby enabling gripping surface 17 to hold magnetic metal components in position through magnetic force. Alternatively, a high friction polymer or rubber coating can be formed over gripping surface 17 in order to increase the gripping ability of gripping surface 16.

Also visible in FIG. 3 are holes 22 and 24 that allow a shaft, rod, or similar component to pass through holder portion 12 and gripping portion 16.

Figure 4:
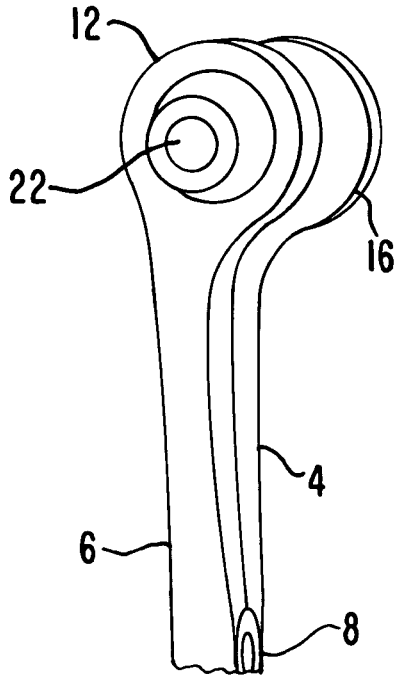
FIG. 4 illustrates a top view of a preferred embodiment of the present invention.

FIG. 4 illustrates a top view of the preferred embodiment of the present invention. Holder portion 12 is secured to second arm 6 Second arm 6 is pivotally mounted to first arm 4, which is secured to gripping surface 16. Hole 22 formed in holder portion 12 allows rods, shafts and the like to pass through holder portion 12. Holder 12 having hole 22 is a shaped annulus.

Figure 5:
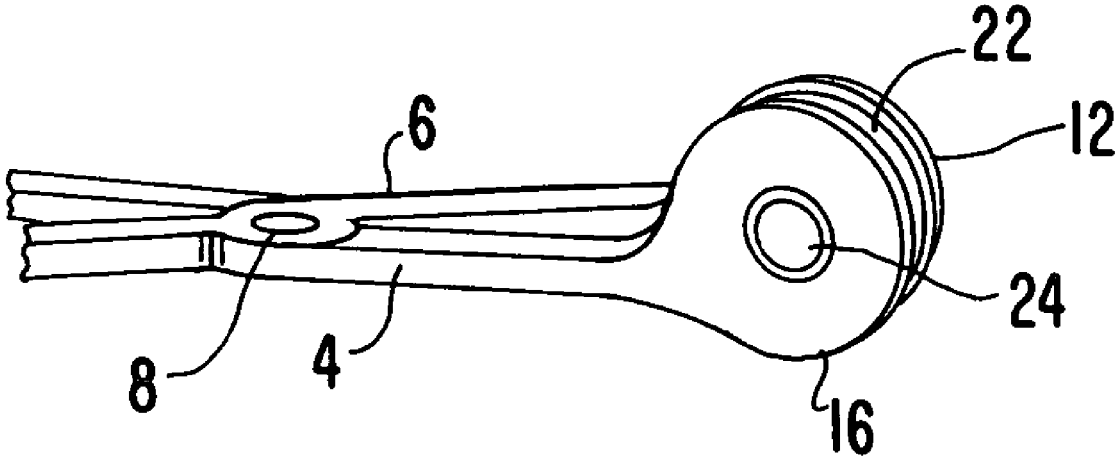
FIG. 5 illustrates a bottom view of a preferred embodiment of the present invention.

FIG. 5 illustrates a bottom view of a preferred embodiment of the present invention. Gripping portion 16 is secured to first arm 4. First arm and second arm are pivotally coupled by pivot joint 8. Hole 24 formed in gripping surface 16 allows rods, shafts and the like to pass through gripping surface 16. Gripping surface 16 having hole 24 is a planar annulus.

Figure 6:
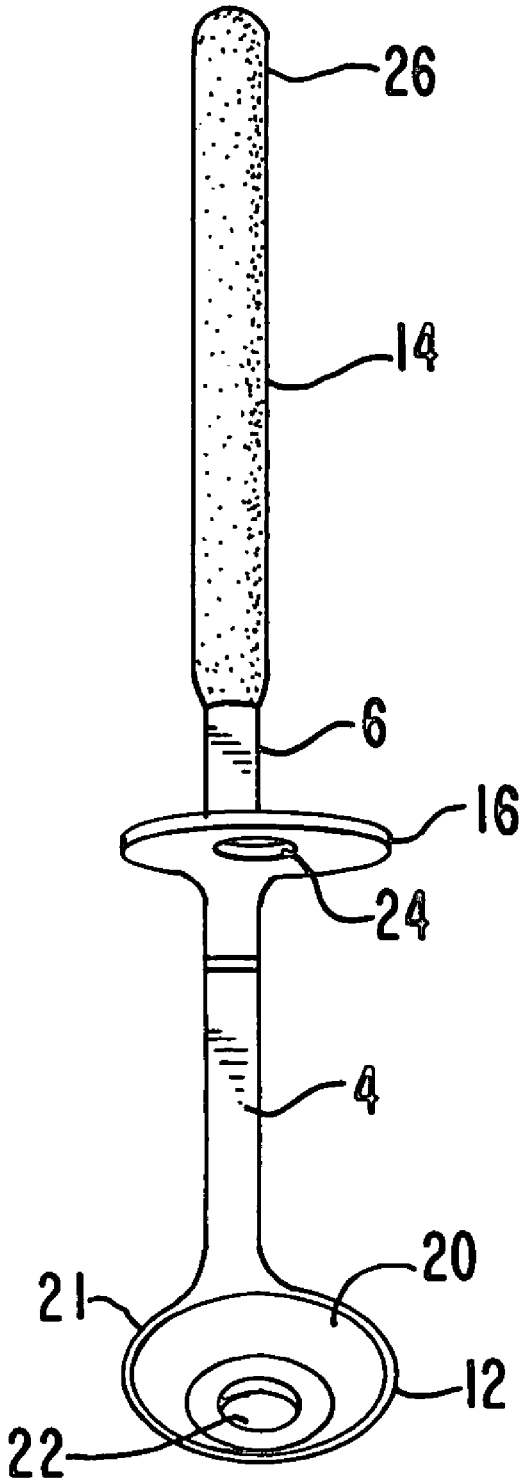
FIG. 6 illustrates an end view of a preferred embodiment of the present invention in an open position.

FIG. 6 illustrates an end view of a preferred embodiment of the present invention in an open position. Recess 20 formed in holder portion 12 enables pliers 2 to close over bushings and other thick annular components. Recess 20 is defined by the shape of holder portion 12 that includes side walls 21. Side walls 21 provide additional mechanical support to bushings and other thick annular components that are held between gripping portion 16 and holder portion 12. Side walls 21 restrict the lateral movement of bushings and the like across gripping portion 16 and holder portion 12, thereby improving the ability of pliers 2 to hold and apply force to thick annular components such as bushings. Holder portion 12 is formed in the shape of an annular cup having side walls 21.

Figure 7:
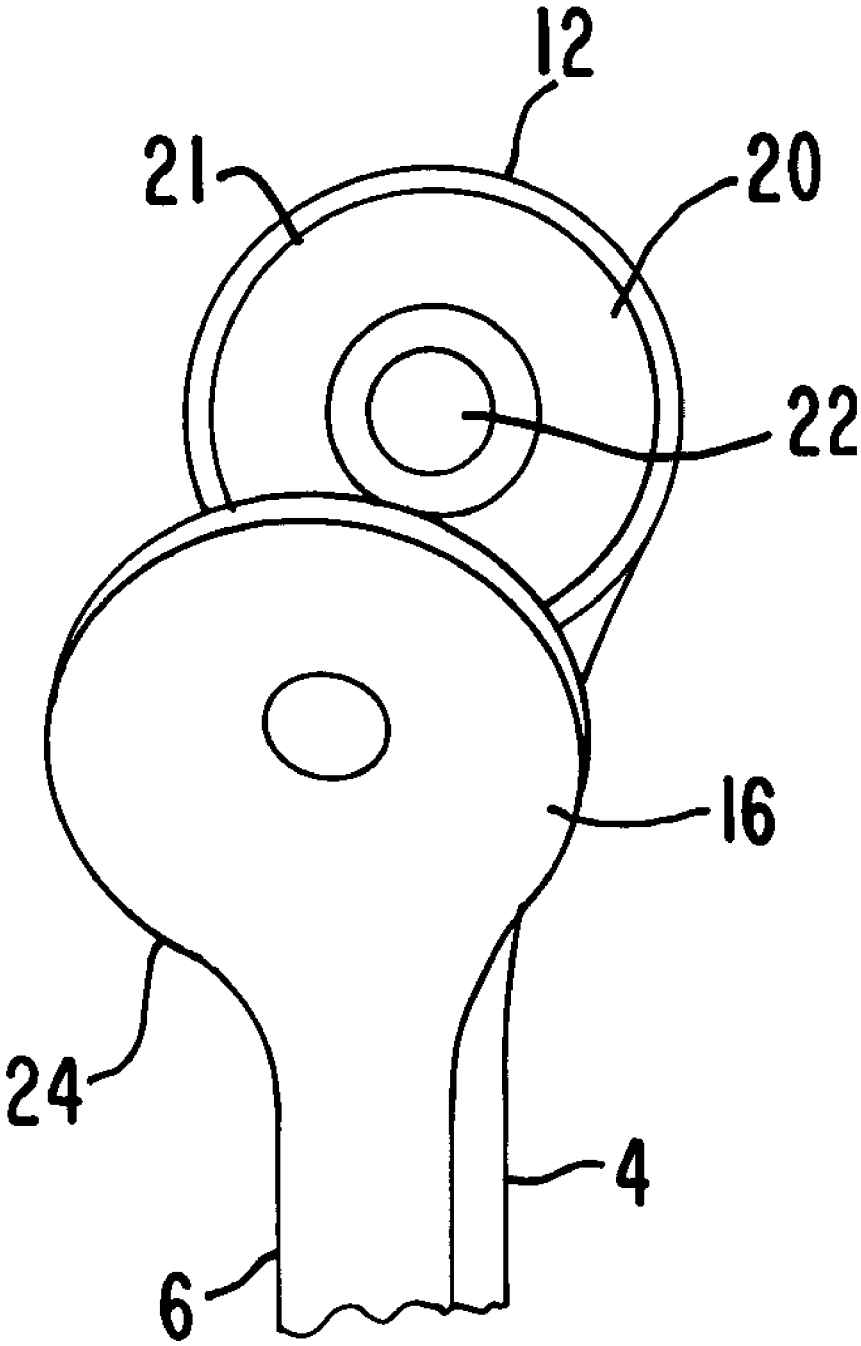
FIG. 7 illustrates a bottom view of a holder portion in accordance with a preferred embodiment of the invention.

FIG. 7 illustrates a bottom view of holder portion 12 in accordance with a preferred embodiment of the invention. Holder portion 12 is formed to define recess 20 with side walls 21. Hole 22 is formed in holder portion 12 to enable rods, shafts and the like to pass through holder portion 12. When pliers 2 are in a closed position where holder portion 12 is in proximity with gripping portion 16, holes 22 and 24 are aligned such that rods, shafts, and the like can pass through pliers 2.

Figure 8:
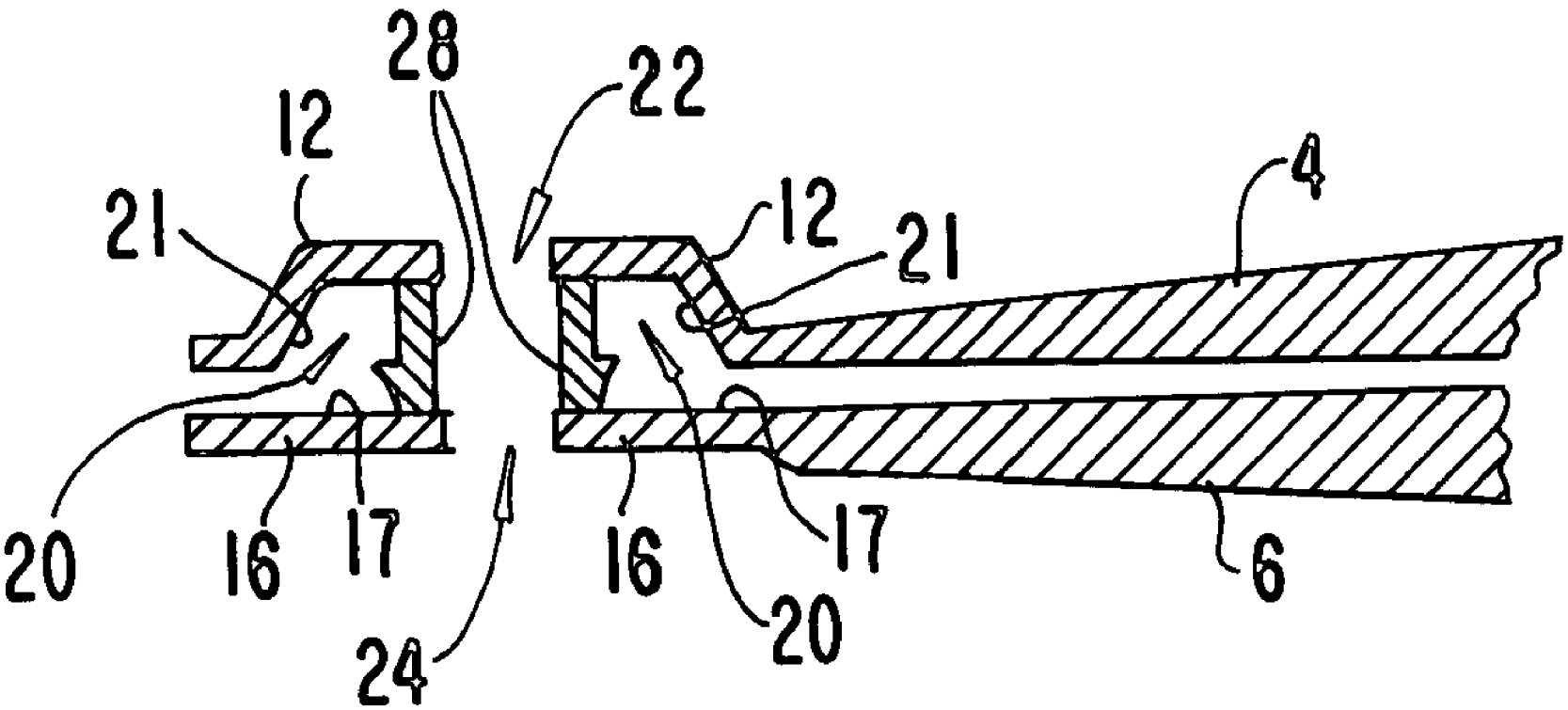
FIG. 8 illustrates a sectional view of a holder and gripping portion in a closed position supporting a bushing in accordance with a preferred embodiment of the present invention along section 1—1 depicted in FIG. 1.

FIG. 8 illustrates a sectional view of holder 12 and gripping portion 16 in a closed position supporting bushing 28 in accordance with a preferred embodiment of the present invention along section 1—1 depicted in FIG. 1. Holder portion 12 is formed as a part of first arm 4. Gripping portion 16 is formed as a portion of second arm 6. Holder portion 12 is formed having side walls 21 to define a recess 20. Holder portion is provided with hole 22 that is aligned with hole 24 formed in gripping portion 16 when pliers 2 are in a closed position. Bushing 28 is illustrated being held in position between holder portion 12 and gripping portion 16. Gripping portion 16 presses bushing 28 up and against holder portion 12. Holes 22 and 24 align with the hole defined by bushing 28, or other thick annular components. In this configuration, rods, shafts and the like can pass both through pliers 2 and through bushing 28. In particular, this configuration of holder portion 12 and gripping portion 16 enables pliers 2 to grip and place bushing 28 within the drive selector linkage assembly of automobiles.

Figure 9:
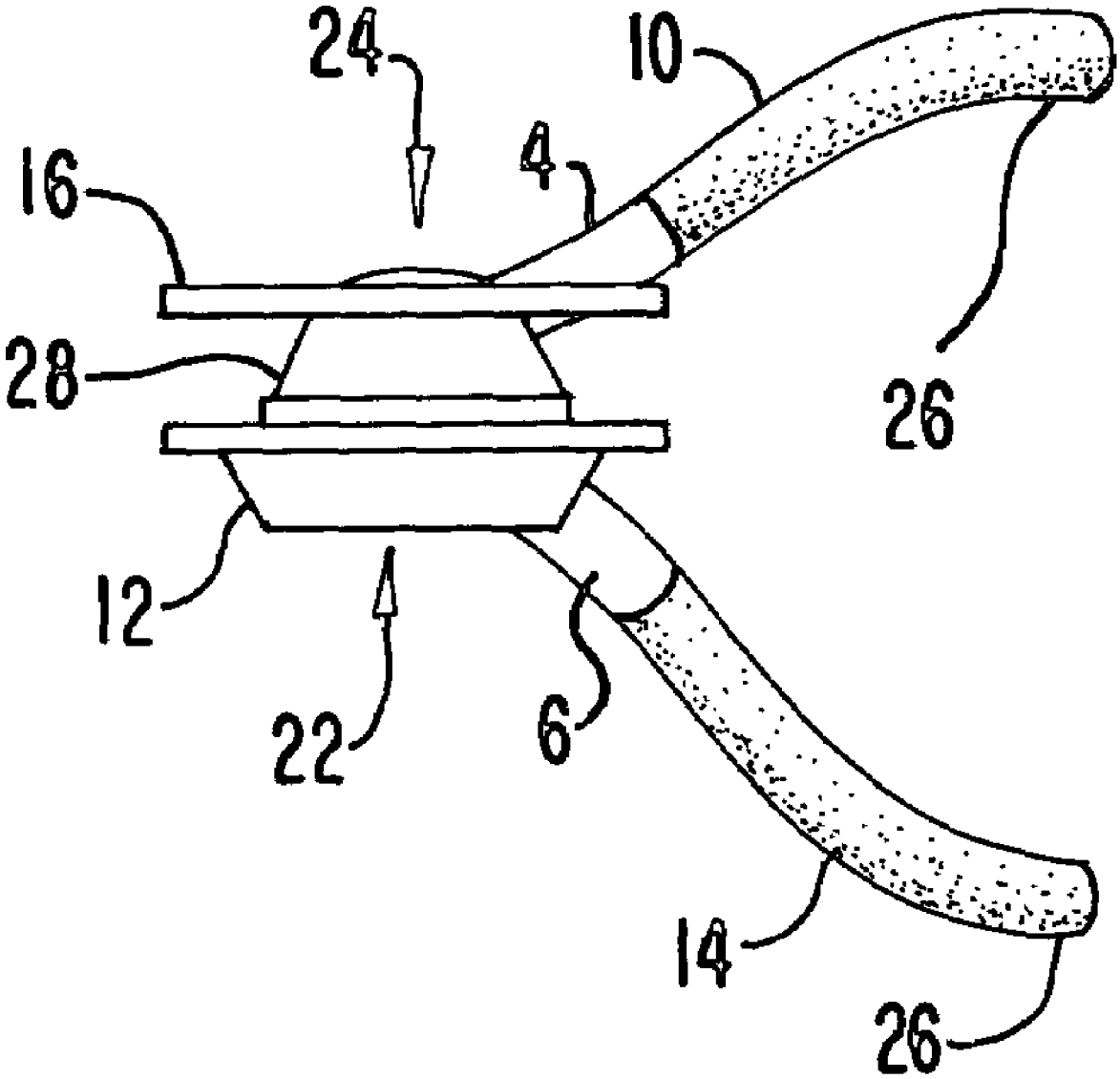
FIG. 9 illustrates an end view of a preferred embodiment of the invention holding a bushing.
Figure 10:
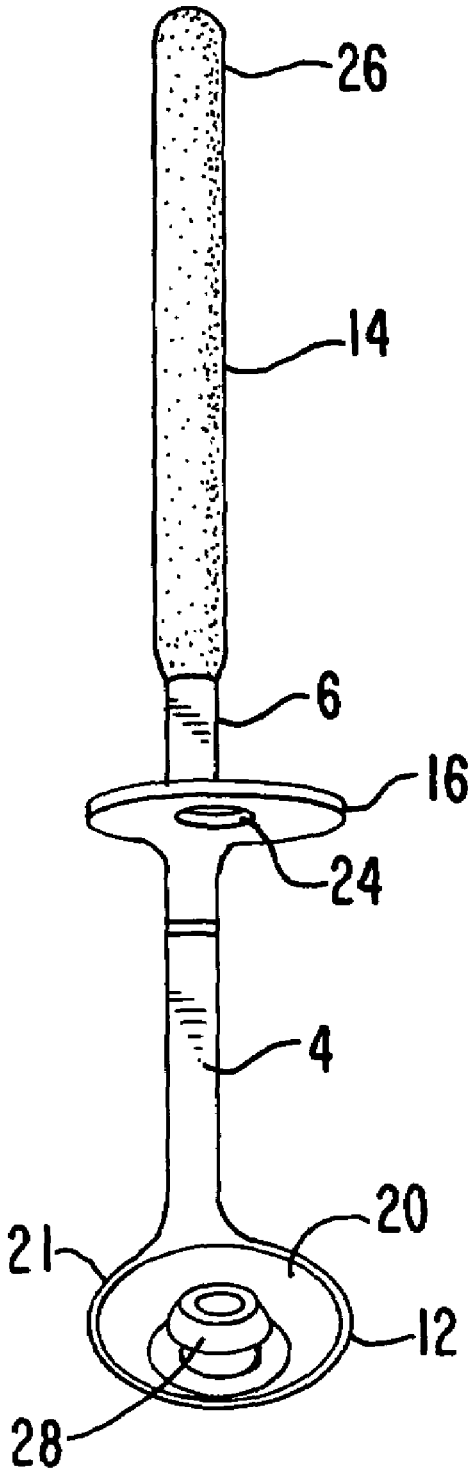
FIG. 10 illustrates an end view of a preferred embodiment of the present invention in an open position holding a bushing.

FIG. 9 illustrates an end view of a preferred embodiment of the invention holding a bushing. Bushing 28 is held by pliers in between gripping portion 16 and holder portion 12. Holes 22 and 24 align with bushing 28 to enable placement of bushing 28 within the drive selector linkage assembly of automobiles. Furthermore, the length of first and second arms 4 and 6 enable pliers to reach the position where bushing 28 is installed 28 within the drive selector linkage assembly of automobiles. Grips 26 on first and second handle portions 10 and 12 aid in the reach of pliers 2 toward the drive selector linkage. As a result, it is possible to reach and install bushings 28 within the drive selector linkage assembly of automobiles without having to remove portions of the automobile. Holder portion 12 is configured with recess 20 to independently hold the bushing to be installed within the drive selector linkage assembly. Gripping portion 16 is configured to apply a force to the bushing suitable to install said bushing within the drive selector linkage assembly of the automobile when first and second handles 10 and 14 of first and second arms 4 and 6 are pivotally operated FIG. 10 illustrates an end view of a preferred embodiment of the present invention in an open position holding bushing 28. Bushing 28 is resting within recess 30 of holder portion 12. Bushing 28 is held by pliers 2 when first and second arms 4 and 6 are pivoted into a closed positioned, thereby bringing gripping portion 16 into position against brushing 28.

Having fully described the invention with reference to the preferred embodiments shown in the attached drawing figures, it will be readily appreciated by those skilled in the art that many changes and modifications may be made to the invention without departing from the essence of the invention and without being included within the spirit and scope of the invention as is defined by the appended claims.

We claim:

1. Pliers for installing a bushing within a drive selector linkage assembly of an automobile, comprising:

a first arm having a first handle portion and a holder portion, said holder portion being configured to retain a bushing during installation within a drive selector linkage assembly of an automobile; and a second arm pivotally mounted to said first arm and having a second handle portion and a gripping portion, said gripping portion configured to apply a force to said bushing suitable to install said bushing within the drive selector linkage assembly of the automobile when said first and second handles of said first and second arms are pivotally operated.

2. The pliers of claim 1, wherein gripping portion is formed as an annulus.

3. The pliers of claim 1, wherein said gripping portion is formed as a planar annulus.

4. The pliers of claim 1, wherein said holder portion has the form of a shaped annulus having sidewalls, thereby defining a recess.

5. The pliers of claim 1, wherein said gripping portion has a gripping surface that has grooves formed therein.

6. The pliers of claim 1, wherein said holder portion is formed as a first annulus and said gripping portion is formed as a second annulus, wherein said first annulus and said second annulus are axially aligned when said pliers are in a closed position.

7. The pliers of claim 1, further comprising a strip attached to said pliers positioned between said first and second arm, whereby said strip places a force against said first and second arm when said pliers are in a closed position.

8. A pair of pliers, comprising:

a first arm having a first handle portion and a holder portion, said holder portion being configured to retain an annular component during installation within a drive selector linkage assembly of an automobile; and a second arm pivotally mounted to said first arm between said first handle portion and said holder portion, wherein said second arm having a second handle portion proximal to said first handle portion and a gripping portion proximal to said holder portion, said gripping portion configured to apply a force to said bushing suitable to install said bushing within the drive selector linkage assembly of the automobile when said first and second handles of said first and second arms are pivotally operated, wherein said first and second handle portions enable said pliers to reach the drive selector linkage assembly of the automobile.

9. The pliers of claim 8, wherein said holder portion is formed having side walls, thereby restricting lateral motion of said bushing within said holder portion.

10. The pliers of claim 8, wherein said gripping portion has a gripping surface that has grooves formed therein.

11. The pliers of claim 8, wherein said holder portion is formed as a first annulus and said gripping portion is formed as a second annulus, wherein said first annulus and said second annulus are axially aligned when said pliers are in a closed position.

12. The pliers of claim 8, further comprising a strip attached to said pliers positioned between said first and said second arm, whereby said strip places a force against said first and second arm to pivot said first and second arms into an open position when said pliers are in a closed position.

13. The pliers of claim 8, wherein said holder portion is parallel to said gripping portion when said pliers are in a closed position and when said bushing is held between said holder portion and said gripping portion.

14. A pair of pliers, comprising:

a first arm having a first handle portion formed at an end and an annular cup formed at an opposite end, said annular cup being configured to retain an annular component; and a second arm pivotally mounted to said first arm between said first handle portion and said annular cup, wherein said second arm having a second handle portion proximal to said first handle portion and a planar annulus proximal to said annular cup, said planar annulus configured to apply a force to said annular component when said first and second handles of said first and second arms are pivotally operated; and wherein said pliers is configured to retain a bushing during installation within a drive selector linkage assembly of an automobile.

15. The pliers of claim 14, wherein said annular cup and said planar annulus are axially aligned when said pliers are in a closed position.

16. The plies of claim 14, wherein said annular cup is formed having sidewalls, thereby defining a recess, wherein said sidewalls restrict lateral motion of said annular component within said annular cup.

17. The pliers of claim 14, wherein said planar annulus has a gripping surface that has grooves formed therein.

18. The pliers of claim 14, further comprising a strip attached to said pliers positioned between said first and said second arm, whereby said strip places a force against said first and second arm to pivot said first and second arms into an open position when said pliers are in a closed position.

19. The pliers of claim 14, wherein said first and second handles are coated with a high friction material.

20. The pliers of claim 14, wherein said annular cup is parallel to said planar annulus when said pliers are in a closed position and said annular component is held between said annular cup and said planar annulus.

21. Pliers for installing a part within an automobile, comprising:

a first arm having a first handle portion and a holder portion, said holder portion being configured to retain a part during installation within an automobile; and a second arm pivotally mounted to said first arm and having a second handle portion and a gripping portion, said gripping portion configured to apply a force to said part suitable to install said part within the automobile when said first and second handles of said first and second arms are pivotally operated; and wherein said pliers is configured to retain a bushing during installation within a drive selector linkage assembly of an automobile.

* * * * *